United States Patent [19]

Berkes et al.

[11] Patent Number: 5,034,298

[45] Date of Patent: Jul. 23, 1991

[54] TONER COMPOSITIONS AND PROCESSES THEREOF

[75] Inventors: John S. Berkes, Webster; Richard B. Lewis, Williamson; Robert J. Gruber, Pittsford; Eugene F. Young, Rochester; Michael J. Oszczakiewicz, Penfield, all of N.Y.

[73] Assignee: Xerox Corporation, Stamford, Conn.

[21] Appl. No.: 429,535

[22] Filed: Oct. 31, 1989

[51] Int. Cl.[5] ..... G03G 9/00; G03G 9/083; G03G 9/107

[52] U.S. Cl. ..... 430/110; 430/111; 430/106.6

[58] Field of Search ..... 430/110, 111, 106.6

[56] References Cited

U.S. PATENT DOCUMENTS 4,187,329 2/1980 Crooks ..... 430/110
4,388,396 6/1983 Nishibayashi et al. ..... 430/110 X
4,859,550 8/1989 Gruber et al. ..... 430/110 X

FOREIGN PATENT DOCUMENTS 0037552 3/1984 Japan ..... 430/106.6
0079363 5/1985 Japan ..... 430/106.6
0275708 12/1986 Japan ..... 430/110

*Primary Examiner*—Marion E. McCamish
*Assistant Examiner*—S. Crossan
*Attorney, Agent, or Firm*—E. O. Palazzo

[57] ABSTRACT

An electrophotographic process which comprises the generation of a latent image; developing the image with a toner composition comprised of resin particles, magnetite particles, and a polymeric fluorocarbon; and subsequently providing the developed image with magnetic ink characters thereon to a reader/sorter device whereby toner offsetting and image smearing is avoided or minimized in said device.

55 Claims, No Drawings

TONER COMPOSITIONS AND PROCESSES THEREOF

BACKGROUND OF THE INVENTION

The present invention is generally directed to toner compositions, and more specifically the present invention is directed to imaging and printing processes with toner compositions, including magnetic, single component, and two component developer compositions. These compositions are particularly useful for generating documents such as personal checks which are subsequently processed in reader/sorters. In one embodiment of the present invention, there are provided processes for generating documents, such as checks, including for example dividend checks, turn around documents such as invoice statements like those submitted to customers by American Express and VISA, corporate checks, highway tickets, rebate checks, other documents with magnetic codes thereon, and the like, with no toner smearing, or wherein toner smearing is substantially minimized. More specifically, in one embodiment the process of the present invention is accomplished with toner and developer compositions containing, especially as external additives, fluorocarbons, such as Teflon® and Kynar®, and wherein image smearing and offsetting of the toner to read and write heads, including offsetting to the protective foil that may be present on the aforesaid heads in magnetic ink character recognition processes and apparatus inclusive of, for example, the read and write heads present in MICR (magnetic ink character recognition) reader/sorters such as the commercially available IBM 3890 TM, NCR 6780 TM reader/sorters from Burroughs Corporation, and the like is minimized, or avoided. Some of the reader/sorter printers contain protective foils thereon, reference for example the IBM 3890 TM, and the problems associated with such protective foils with respect to read and write heads with no foils are alleviated with the processes of the present invention. With the processes utilizing the toner and developer compositions illustrated, the problems of image smearing to, and offsetting from the read and write heads in magnetic ink character recognition apparatuses is substantially eliminated. Moreover, in another embodiment the present invention is directed to improved economical processes for generating documents such as personal checks suitable for magnetic image character recognition wherein image smearing and toner offsetting, including offsetting to read and/or write heads including those with protective foils thereon, or unprotected heads is avoided when such documents are processed in the aforementioned reader/sorters. Furthermore, in another embodiment of the present invention there is provided a process for applying to developed images subsequent to, or simultaneously with fusing, especially magnetic ink developed images such as personal checks, a layer of fluorocarbon additives; and wherein image smearing to, and offsetting from the read and write heads in magnetic ink character recognition apparatuses is substantially eliminated. The toner compositions selected for the process of the present invention in an embodiment are comprised of resin particles, pigment particles, including magnetic components such as magnetites and fluorocarbons as internal, or external additives. There is also provided in accordance with the present invention processes with positively or negatively charged toner compositions comprised of resin particles, pigment particles, fluorocarbons, and charge enhancing additives. In addition, the present invention is directed to processes with developer compositions comprised of the aforementioned toners and carrier particles. Further, the processes of the present invention with the toner and developer compositions illustrated, including single component toners, enable reliable output copy quality and stable triboelectric charging properties for the toner compositions selected.

Although it is not desired to be limited by theory, toner offset is eliminated, or minimized with the toners, developers, and processes of the present invention, it is believed, because of the presence of the fluorocarbon additives, which additives are free of objectionable odor during fusing, and do not cause undesirable fuser roll contamination as is the situation with some wax components. Offset results from, for example, the developed toner image being removed from the MICR (magnetic ink character recognition) document, such as a check to the read and/or write heads contained in MICR readers, such as the IBM 3890 TM and the NCR 6780 TM. When the aforesaid offset is eliminated or substantially reduced, the problem of image smearing onto the MICR documents, such as personal checks, is also avoided or minimized. Apparently, although it is not desired to be limited by theory the fluorocarbon additive functions as a lubricant against offset. By offset is meant, for example, that the toner is undesirably released from the document, such as personal checks, and transfers and sticks to the aforementioned read and/or write heads. As a result, toner is removed from the checks, or other documents primarily in a continuous manner causing image smearing, and substantially preventing the characters on the checks from being read magnetically and thus rejected in most instances. With the toners, developers and processes of the present invention, these problems are avoided or minimized, and more specifically the reject rate is less than one half of 1 percent for 5,000 checks processed through, for example in the aforesaid IBM 3890 TM reader/sorter, 10 times in an embodiment of the present invention. With the processes and compositions of the present invention, in an embodiment thereof the reject rate is less than one half of 1 percent, it being noted that an acceptable reject rate usually does not exceed one half of 1 percent (0.5 percent) as determined by the American National Standards Institute (ANSI). Typically, the reject rate with the toners, developers, and processes of the present invention is from about 0 to about 0.3 percent depending, for example, on the sorter set up conditions as contrasted to a reject rate in excess of one half of 1 percent, which is not acceptable, with processes utilizing toner and developer compositions that contain, for example, no additives or other ineffective additives. With toner build up on the read/write heads, the excess toner is released to the check document being processed causing image smearing, which is avoided with the processes of the present invention.

With further respect to the present invention, the process is particularly applicable to the generation of documents including personal checks, which have been fused with soft roll fusers. Fuser rolls such as silicone rolls or other conformable fuser rolls, reference for example the soft fuser rolls incorporated into the Xerox Corporation 4040 TM machine, are particularly useful with the toners, developers, and processes of the present invention.

The documents, including the personal checks mentioned herein, can be obtained, for example, by generating a latent image thereon and subsequently developing the image, reference U.S. Pat. No. 4,517,268, the disclosure of which is totally incorporated herein by reference, with the toner and developer compositions illustrated herein. The developed image that has been created, for example, in the Xerox Corporation 9700 TM MICR printer, reference the aforesaid '268 patent, contains thereon, for example, the characters zero, 1, 2, 3, 4, 5, 6, 7, 8 and 9, and up to four symbols (E-13B and CMC-7 font), which characters are magnetically readable by the IBM 3890 TM, or other similar apparatus. One of the problems avoided with the processes of the present invention is to eliminate or reduce the offsetting of the toner as indicated herein to the read and write heads in the apparatus selected for this purpose such as the IBM 3890 TM.

Processes for eliminating or minimizing image smearing in MICR processes are illustrated in U.S. Pat. No. 4,859,550, the disclosure of which is totally incorporated herein by reference. More specifically, there are illustrated in this patent processes for generating documents, which comprise the formation of images, such as latent images, with a printing device especially devices generating from about 8 to about 135 prints per minutef developed the image with a single, or two component developer composition (toner plus carrier), which compositions contain, for example, resin particles, magnetite particles, low molecular weight hydrocarbons with functional groups, or polymeric alcohols; subsequently transferring the developed image to a suitable substrate; permanently affixing the image thereto; and thereafter processing the documents in reader/sorters wherein image offsetting and image smearing are avoided or substantially reduced. Some examples of the aforementioned process wherein a toner with no hydrocarbon, or polymeric alcohol additive is selected as illustrated in U.S. Pat. No. 4,517,268, the disclosure of which is totally incorporated herein, especially column 3. Examples of high speed electronic printing devices disclosed in the aforementioned patent, which devices can also be utilized for the process of the present invention, include the 8700 TM, and 9700 TM MICR printers available from Xerox Corporation. More specifically, there can be selected for the generation of the documents with magnetic characters thereon the Xerox Corporation 9700 TM MICR printer, about 120 prints per minute, the Xerox Corporation 8700 TM MICR printer, about 80 prints per minute, and the like. Some disadvantages associated with the polymeric alcohols and other additives of the aforementioned '550 patent, which disadvantages are avoided and/or minimized with the present invention, include objectionable odor during fusing, fuser roll contamination, and/or limited fuser roll life.

Developer and toner compositions with certain waxes therein are known. For example, there are disclosed in U.K. Patent Publication 1,442,835 toner compositions containing resin particles and polyalkylene compounds, such as polyethylene and polypropylene of a molecular weight of from about 1,500 to 6,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference U.S. Pat. No. 3,635,704, issued Jan. 18, 1972, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, begining at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

In a patentability search report, the following U.S. patents were recited: U.S. Pat. No. 4,517,268, the disclosure of which is totally incorporated herein by reference which illustrates xerography to print MICR legends, and more specifically describes a MICR process wherein the developer is comprised of a toner of magnetite and resin, and the carrier is comprised of ferrite cores; also note column 3, beginning at around line 15, wherein it is indicated that the process of the '268 patent in one embodiment involves the generation of documents including personal checks, which documents are suitable for magnetic image character recognition and wherein conventional electrostatographic methods are selected and wherein the magnetic toner composition contains from about 20 percent by weight to about 70 percent by weight of various magnetites and 30 to 80 percent of certain toner resin particles; and also note the disclosure in column 5, beginning at line 10 wherein developer compositions are formulated; U.S. Pat. No. 4,268,598, the disclosure of which is totally incorporated herein by reference, which discloses a developer comprised of toner powder particles and a fluoroaliphatic sulfonamido surface active material, which developers may be selected for printing tickets, and the like, reference column 10 for example; also note column 7, wherein both pressure fixable and heat fusible toners may be employed, preferably conductive and magnetically attractable; U.S. Pat. No. 4,339,518, the disclosure of which is totally incorporated herein by reference, which discloses the incorporation of fluorine containing resins in a toner that will form a xerographic print that can be selected as a printing master; also note column 4, beginning at around line 16, wherein the dielectric toner contains a particular flow reading containing resin in an amount of at least 0.5 percent by weight calculated as fluorine, and that the fluorine containing resin has an excellent frictional charging property, a low surface energy, and excellent lubricating property with examples of the fluorine containing resins being outlined in column 4, beginning at around line 40, and the preparation of dielectric toner wherein the fluorine is incorporated into the toner composition is outlined in column 6, beginning at line 26; U.S. Pat. No. 4,388,396, the disclosure of which is totally incorporated herein by reference, which discloses magnetic toners with incorporated fluorocarbons as offset preventing agents; also disclosed, reference column 3, are developers including one component type developers comprising particles in which a fine powder of a magnetic substance has been incorporated therein with examples of aliphatic fluorocarbons being illustrated in column 4, beginning at around line 18, and examples of magnetites being outlined in column 9, beginning at around line 36; further, note that the fluorocarbon is incorporated into the toner, and note the disclosure beginning in column 10, line 25; U.S. Pat. No. 4,560,635 relating to magnetic toners wherein, for example, vinylidnene fluoride can be selected as a resin; U.S. Pat. No. 4,590,142 relating to the use of polytetrafluoroethylene as a lubricant for magnetic toners; and as background or collateral interest U.S. Pat. Nos. 3,778,262; 3,977,871; 4,002,570 and 4,051,077.

Described in U.S. Pat. No. 4,367,275 are methods of preventing offsetting of electrostatic images of the toner composition to the fuser roll, which toner subsequently offsets to supporting substrates such as papers wherein there are selected toner compositions containing specific external lubricants including various waxes, see column 5, lines 32 to 45, which waxes are substantially different in their properties and characteristics than the additives selected for the toner and developer compositions of the present invention; and moreover, the toner compositions of the present invention with the aforementioned fluorocarbon additives possess advantages, such as elimination of toner spotting, not achievable with the toner and developer compositions of the '275 patent.

In U.S. Pat. No. 4,883,736, the disclosure of which is totally incorporated herein by reference, are illustrated toner compositions including magnetic single component, and colored toner compositions containing certain polymeric alcohol waxes. More specifically, there is disclosed in this patent the elimination of toner spots or comets with developer compositions comprised of toner compositions containing resin particles, particularly styrene butadiene resins, pigment particles such as magnetites, carbon blacks or mixtures thereof, polymeric hydroxy waxes available from Petrolite, which waxes can be incorporated into the toner compositions as internal additives or may be present as external components; and optional charge enhancing additives, particularly, for example, distearyl dimethyl ammonium methyl sulfate, reference U.S. Pat. No. 4,560,635, the disclosure of which is totally incorporated herein by reference, and carrier particles. As preferred carrier components for the aforementioned compositions, there are selected steel or ferrite materials, particularly with a polymeric coating thereover, including the coatings as illustrated in U.S. Ser. No. 751,922, (now abandoned) entitled Developer Composition with Specific Carrier Particles, the disclosure of which is totally incorporated herein by reference. One particularly preferred coating illustrated in the aforementioned copending application is comprised of a copolymer of vinyl chloride and trifluorochloroethylene with conductive substances dispersed in the polymeric coating inclusive of, for example, carbon black. One embodiment disclosed in the aforementioned copending application is a developer composition comprised of styrene butadiene copolymer resin particles, and charge enhancing additives selected from the group consisting of alkyl pyridinium halides, ammonium sulfates, and organic sulfate or sulfonate compositions; and carrier particles comprised of a core with a coating of vinyl copolymers, or vinyl homopolymers. The polymeric components of the aforesaid copending application are also selected for various embodiments of the present invention as illustrated herein.

In a Petrolite, Inc. brochure dated 1985, there are disclosed polymeric hydroxy waxes, which brochure indicates that the waxes may have utility as toner.

Moreover, toner and developer compositions containing charge enhancing additives, especially additives which impart a positive charge to the toner resin, are well know. Thus, for example, there is described in U.S. Pat. No. 3,893,935 the use of certain quaternary ammonium salts $(R_4N)+X-$ as charge control agents for electrostatic toner compositions. There are also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there is illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride.

Other prior art disclosing positively charged toner compositions with charge enhancing additives include U.S. Pat. Nos. 3,944,493; 4,007,293; 4,079,014 and 4,394,430.

Although the above described toner and developer compositions are useful for their intended purposes, there is a need for improved compositions. More specifically, there is a need for toners, developers, and processes enabling the generation of documents such as personal checks, wherein toner offsetting and image smearing is avoided. There is also a need for the generation of developed images including the generation of personal checks in laser printers utilizing magnetic ink character recognition technology, wherein toner offset to protective foils present on the read and write heads is avoided, and image smearing is eliminated or minimized by adding to the toner, as an internal or external additive, fluorocarbons. In addition, there is a need for MICR processes for generating documents, such as personal checks, with toner and developer compositions that maintain their triboelectrical characteristics for extended time periods exceeding, for example, 500,000 developed images. In addition, there is a need for MICR processes with toner and developer compositions wherein toner offsetting to protective foils, and image smearing on documents generated is reduced or eliminated. Furthermore, there is a need for processes wherein image smearing and offsetting is avoided by, for example, applying to the developed image, subsequent to or during fusing, a layer of fluorocarbon additives.

SUMMARY OF THE INVENTION

It is an object of the present invention to provide toner and developer compositions, processes for obtaining images thereof, and particularly processes for generating documents such as personal checks which are subsequently processed in reader/sorters with many of the advantages illustrated herein.

Another object of the present invention resides in the provision of processes for generating documents, such as personal checks, suitable for magnetic ink character recognition, which processes utilize toner and developer compositions containing fluorocarbons.

In another object of the present invention there are provided processes for generating documents, such as personal checks, suitable for magnetic ink character recognition, which processes utilize toner and developer compositions containing fluorocarbons in an effective amount and wherein toner offsetting and image smearing is avoided or minimized.

Moreover, another object of the present invention relates to processes wherein toner offsetting to the read and write heads, including those that are not protected, or those that contain a protective foil thereon, is avoided.

In another object of the present invention, there are provided processes for processing documents wherein toner offsetting and image smearing are avoided or minimized.

Also, in another object of the present invention there are provided toners and processes wherein, for example, image smearing and toner offsetting is avoided when documents such as checks containing magnetic characters (MICR) thereon are utilized in commercial sorters, and/or reader/sorters.

Additionally, in yet another object of the present invention there are provided magnetic ink character recognition processes (MICR), which processes are suitable for the generation of documents with toner and developer compositions containing fluorocarbons incorporated into the toner, and/or on the surface thereof, and wherein these checks can be utilized in commercial sorters, and/or reader/sorters such as the IBM 3890 TM without toner offsetting and image smearing as illustrated herein.

Also, in another object of the present invention there are provided processes for applying to developed images fluorocarbon additives primarily for the purposes of eliminating image smearing and toner offsetting in commercial sorters, and/or reader/sorters, such as the IBM 3890 TM and the NCR 6780 TM, with toner and developer compositions containing polymeric fluorocarbons.

Additionally, in still another object of the present invention there are provided methods for avoiding offsetting and image smearing by the application of a layer of fluorocarbon additive materials to the developed, fused MICR image simultaneously with fusing or subsequent to fusing.

In another object of the present invention there are provided processes for generating documents, such as personal checks, suitable for magnetic image character recognition, which processes utilize toner and developer compositions containing fluorocarbon additives and wherein these documents can be utilized in commercial sorters, such as the IBM 3890 TM and the NCR 6780 TM, without toner offsetting and image smearing as illustrated herein.

Another object of the present invention resides in processes for generating documents, such as personal checks, suitable for magnetic image character recognition wherein the toners and developers utilized contain fluorocarbon additives, and wherein fuser roll contamination and an objectionable odor during fusing are eliminated and/or minimized thus avoiding some of the disadvantages when waxy materials are selected as additives.

These and other objects of the present invention are accomplished by providing toners, developers, and processes with developer compositions and toner compositions that are useful for generating documents inclusive of personal checks, which documents are subsequently processed in reader/sorter devices as illustrated herein. More specifically, the present invention is directed to processes for generating documents, which comprise the formation of images, such as latent images with a printing device, including devices generating from about 8 to about 135 prints per minute; developing the image with a single or two component developer composition (toner+carrier) as illustrated herein, which compositions contain, for example, resin particles, magnetite particles, and fluorocarbon components; subsequently transferring the developed image to a suitable substrate; permanently affixing the image thereto; and thereafter processing the documents in reader/sorters wherein image offsetting and image smearing are avoided or substantially reduced. Some examples of the aforementioned process wherein a toner with no hydrocarbon or polymeric alcohol additive is selected is illustrated in U.S. Pat. No. 4,517,268, especially column 3, the disclosure of which is totally incorporated herein. Examples of high speed electronic printing devices disclosed in the aforementioned patent, which apparatuses can also be utilized with the toners, developers, and processes of the present invention, include the 8700 TM and 9700 TM MICR printer available from Xerox Corporation. More specifically, there can be selected for the generation of the documents with magnetic characters thereon the Xerox Corporation 9700 TM MICR printer, about 120 prints per minute, the Xerox Corporation 8700 TM MICR printer, about 80 prints per minute, and the like. Also, there can be selected for the processes with the toners and developers of the present invention other devices including ionographic printers such as the Delphax 4060 TM printers, the Xerox Corporation 4040 TM, which contains a soft fuser roll for fixing purposes, the Xerox Corporation 4045 TM and 4050 TM. Thereafter, the formed documents with magnetic characters thereon are processed in reader/sorter apparatuses as illustrated herein, and there results the advantages as indicated including low, and in some instances zero, reject rates.

One specific embodiment of the present invention is directed to toner compositions comprised of resins particles, pigments, or dyes, and fluorocarbons; developer compositions thereof; and processes for obtaining images. One process embodiment comprises the generation of a latent image and developing the latent images with a toner composition comprised of resin particles, pigment particles, magnetic particles, such as magnetite, and a fluorocarbon additive component. Another embodiment of the present invention is directed to an electrophotographic process for obtaining images, which comprises the generation of a latent image in an electronic printing device; thereafter developing the characters with a toner composition comprised of resin particles, pigment particles, magnetite particles, and a fluorocarbon; and subsequently processing the documents with magnetic characters thereon in reader/sorters. Also, in a further embodiment of the present invention there is provided a xerographic process, which comprises forming a latent image on an imaging member; developing the image with a toner composition comprised of resin particles, magnetite particles, and pigment particles; subsequently transferring the image to a suitable substrate; fixing the image thereto; simultaneously, or thereafter applying to the developed image a fluorocarbon. The aforementioned developed images, especially personal checks with magnetic characters thereon, can then be utilized in a reader/sorter without offsetting and image smearing as indicated herein.

The toner compositions selected for the process of the present invention are comprised of resin particles, magnetites, and optional pigment particles, such as carbon black and fluorocarbons. In one embodiment of the present invention, there are selected for the process of the present invention toner compositions comprised of resin particles, magnetite particles, optional pigment particles, and polymeric fluorocarbons. Furthermore, there are provided in accordance with the present invention processes with positively or negatively charged toner compositions comprised of resin particles, pigment particles, magnetite particles, polymeric fluorocarbons, and charge enhancing additives. Another embodiment of the present invention is directed to processes with developer compositions comprised of the aforementioned toners and carrier particles. Additionally, the toner compositions selected may include as additives, preferably external additives, in amounts, for example, of from about 0.1 to about 1.0 percent, and preferably 0.5 percent by weight of silica such as Aerosil R972, metal salts, metal salts of fatty acids such as zinc stearate, and the like, reference U.S. Pat. Nos. 3,720,617; 3,900,588 and 3,590,000, the disclosures of which are totally incorporated herein by reference.

Illustrative examples of suitable toner resins selected for the toner and developer compositions, and present in various effective amounts, providing the total amount of all components is equal to about 100 percent by weight, such as, for example, from about 40 percent by weight to about 90 percent by weight, and in one embodiment from about 30 to 85 weight percent, include polyesters, polyamides, epoxy resins, polyurethanes, polyolefins, vinyl resins and polymeric esterification products of a dicarboxylic acid, and a diol comprising a diphenol. Various suitable vinyl resins may be selected as the toner resin including homopolymers or copolymers of two or more vinyl monomers. Typical vinyl monomeric units include styrene, p-chlorostyrene, unsaturated monoolefins such as ethylene, propylene, butylene, isobutylene, and the like; vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; styrene butadiene copolymers, especially styrene butadiene copolymers prepared by a suspension polymerization process, reference U.S. Pat. No. 4,558,108, the disclosure of which is totally incorporated herein by reference, Pliolites®, crosslinked resins such as styrene acrylates or methacrylates crosslinked with divinylbenzene; and mixtures thereof.

As a specific toner resin, there can be selected the esterification products of a dicarboxylic acid and a diol comprising a diphenol, which components are illustrated in U.S. Pat. No. 3,590,000, the disclosure of which is totally incorporated herein by reference. Other specific toner resins included styrene/methacrylate copolymers, styrene/acrylate copolymers, and styrene/butadiene copolymers, especially those as illustrated in the aforementioned '108 patent; and styrene butadiene resins with high styrene content, that is exceeding from about 80 to 85 percent by weight of styrene, which resins are available as Pliolites from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol, and pentaerythritol.

Examples of magnetites selected for the toner and developer compositions utilized for the process of the present invention include those commercially available, such as Mapico Black, which magnetites are generally present in the toner composition in an effective amount of, for example, from about 35 percent by weight to about 70 percent by weight, and preferably in an amount of from about 50 percent by weight to about 60 percent by weight. Alternatively, there can be selected mixtures of magnetites with pigment particles such as carbon black or equivalent pigments, which mixtures, for example, contain from about 35 percent to about 60 percent by weight of magnetite, and from about 0.5 percent to about 10 percent by weight of carbon black. Also, there may be selected hard, or acicular magnetites in amounts of from about 15 to about 40, and preferably from about 20 to about 30 percent by weight. Examples of hard magnetites include MO4232 available from Pfizer Chemical. The toner polymer is usually present in an amount of from about 30 to about 85 percent by weight.

Illustrative examples of selected optional charge enhancing additives present in various effective amounts such as, for example, from about 0.05 to about 10 percent by weight, and more preferably from about 0.5 to about 2 percent by weight, and enabling positively charged toner compositions with a triboelectric charge, for example, of from about 15 to about 40 microcoulombs per gram include alkyl pyridinium halides, such as cetyl pyridinium chlorides, reference U.S. Pat. No. 4,298,672, the disclosure of which is totally incorporated herein by reference; cetyl pyridinium tetrafluoroborates, quaternary ammonium sulfate, and sulfonate charge control agents as illustrated in U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives; and the like. Examples of charge enhancing additives present in various effective amounts, such as, for example, from about 0.05 to about 10 percent by weight, and preferably from about 1 to about 5 percent by weight, and more preferably from about 0.5 to about 2 weight percent, that enable negatively charged toners with a triboelectric charge, for example, of from about −15 to about −40 microcoulombs per gram include Spilon TRH available from Hodogaya Chemical, orthohalophenylcarboxylic acids, reference U.S. Pat. No. 4,411,974, the disclosure of which is totally incorporated herein by reference, potassium tetraphenyl borates, and the like.

With further respect to the toner and developer compositions selected for the processes of the present invention, an important component present that enables many of the advantages illustrated herein to be obtained is the fluorocarbon, examples of which include aliphatic and aromatic fluorocarbons, such as polyvinylidene fluoride, polytetrafluoroethylene, polyvinylfluoride, fully (all hydrogens substituted with fluorine) fluorinated polymeric ethylene propylene, polypentafluorostyrene, mixtures thereof, and the like, which fluorocarbons are present in various effective amounts. More specifically, the polymeric fluorocarbons are present, for example, in an amount of from about 0.1 percent to about 10 percent by weight. As internal additives, the polymeric fluorocarbons are preferably present in an amount of from about 2 percent by weight to about 10 percent by weight, while as external additives the fluorocarbons are preferably present in an amount of from about 0.3 percent by weight to about 2 percent by weight. Toner and developer compositions with the polymeric fluorocarbons present internally are formulated by initially blending the toner binder resin particles, pigment particles, and fluorocarbons, and other optional components. When the fluorocarbons are present as external additives, the toner composition is initially formulated comprised of, for example, resin particles and pigment particles; and subsequently there is added thereto the polymeric fluorocarbons. Usually when present in the bulk of the toner or as an internal additive an effective amount of the polymeric fluorcarbon is exposed. The aforementioned fluorocarbons are commercially available from, for example, Pennwalt Chemical Company, E. I. DuPont (Teflon®, Kynar®), Liquid Nitrogen Products Corporation, and 3M® possess an average particle diameter of from about 0.1 to about 5, and preferably from about 0.2 to about 1 micron, it is believed.

Of importance with respect to the processes of the present invention in an embodiment thereof is the presence of the aforementioned polymeric fluorocarbons with, for example, a molecular weight average of from less than about $10^4$ and preferably from about $10^5$ to about $10^6$ and a static coefficient of friction of from about 0.04 to about 0.3. It is believed that it is these components which, in combination with the other components of the toner and/or developer, eliminate, substantially reduce or minimize toner offsetting, including offsetting to the protective foil present on the read and write heads of reader/sorters present, for example, in the IBM 3890 TM apparatus, and substantially eliminates or avoids image smearing as indicated herein.

Illustrative examples of carrier particles that can be selected for mixing with the toner compositions, thus permitting two component developers that can be selected for the processes of the present invention, include those particles that are capable of triboelectrically obtaining a charge of opposite polarity to that of the toner particles. Accordingly, the carrier particles can be selected to be of a negative polarity thereby enabling the toner particles, which are positively charged, to adhere to and surround the carrier particles. Alternatively, there can be selected carrier particles with a positive polarity enabling toner compositions with a negative polarity. Illustrative examples of carrier particles that may be selected include steel, nickel, iron, ferrites, including copper zinc ferrites, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating thereover several of which are illustrated, for example, in U.S. Ser. No. 751,922 (now abandoned) relating to developer compositions with certain carrier particles, the disclosure of which is totally incorporated herein by reference. More specifically, there are illustrated in the aforementioned copending application carrier particles comprised of a core with a coating thereover of vinyl polymers, or vinyl homopolymers. Examples of specific carriers illustrated in the copending application are those comprised of a steel or ferrite core with a coating thereover of a vinyl chloride/trifluorochloroethylene copolymer, which coating contains therein conductive particles, such as carbon black. Other carrier polymeric coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride and trichlorofluoroethylene; and other known coatings. There can also be selected as carriers components comprised of a core with a double polymer coating thereover, reference U.S. Pat. No. 4,937,166, and U.S. Pat. No. 4,935,326, the disclosures of which are totally incorporated herein by reference. More specifically, there is detailed in these patents a process for the preparation of carrier particles with substantially stable conductivity parameters which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000 microns, thus allowing these particles to possess sufficient density to avoid adherence to the electrostatic images during the development process. The carrier particles can be mixed with the toner particles in various suitable combinations, however, best results are obtained when about 1 to about 5 parts per toner to about 100 parts by weight of carrier are mixed, and wherein the coating weight of the polymeric material optionally present on the carrier is from about 0.1 to about 5 and preferably from about 0.3 to about 1.0 weight percent.

The toner compositions illustrated herein can be prepared by a number of known methods, including mechanical blending and melt blending the toner resin particles, pigment particles or colorants, and polymeric fluorocarbons followed by mechanical attrition. Other methods include those well known in the art such as spray drying, mechanical dispersion, melt dispersion, dispersion polymerization, and suspension polymerization. More specifically, the toner compositions can be prepared by the simple mixing of polymeric resin, magnetite, and fluorocarbon particles while heating, followed by cooling, micronization to enable toner size particles of, for example, an average diameter of from about 10 to about 25 microns, and subsequently classifying these particles for the primary purpose of removing fines, that is for example particles with a diameter of 5 microns or less, and very large coarse particles, that is with an average diameter of greater than 30 microns. Also, the aforementioned toners can be prepared in a similar manner with an extrusion device wherein the product exiting from such a device is severed into pieces followed by micronization and classification.

The toner and developer compositions of the present invention may be selected for use in developing images in electrophotographic imaging systems containing therein, for example, conventional photoreceptors, such as selenium and selenium alloys, including selenium arsenic, selenium tellurium, selenium tellurium arsenic, and the like; doped selenium and selenium alloys wherein the dopant is a halogen such as chlorine and is present in various effective amounts such as 200 to 500 parts per million, and the like. Also useful, especially wherein there is selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, and vanadyl phthalocyanines, while examples of charge transport layers include the aryl amines as disclosed in U.S. Pat. No. 4,265,990. Moreover, there can be selected as inorganic photoconductors hydrogenated amorphous silicon, reference for example U.S. Pat. Nos. 4,544,617; 4,613,556; 4,634,647; 4,663,258 and 4,666,806, the disclosures of each of the aforementioned patents being totally incorporated by reference; and hydrogenated amorphous carbon imaging members, reference U.S. Pat. No. 4,634,648, the disclosure of which is totally incorporated herein by reference; and as photogenerating pigments squaraines, perylenes, and the like.

The developer composition of the present invention in one embodiment is comprised of a toner composition with styrene butadiene resin particles (91/9), about 32 percent by weight of magnetite, available as MO4232, about 2 percent by weight of carbon black, about 1.0 percent by weight of the charge enhancing additive distearyl dimethyl ammonium methyl sulfate, and as an internal additive about 2 to about 10 percent by weight of the polymeric fluorocarbons, such as Teflon® or Kynar® illustrated herein, and carrier particles comprised of a steel core with a coating thereover of a polymer of, for example, a vinyl chloride/trichlorofluoroethylene copolymer available as FPC 461, which coating has dispersed therein conductive components such as carbon black particles.

As preferred magnetites selected for the toner compositions and the processes of the present invention, in several embodiments thereof the magnetites as illustrated in U.S. Pat. No. 4,517,268, the disclosure of which is totally incorporated herein by reference, are utilized.

A further embodiment of the present invention relates to the provision of processes for generating images, including the generation of personal checks as indicated herein, wherein subsequent to, or simultaneously with development and fusing, especially soft roll fusing, there can be applied, it is believed, to the image the polymeric fluorocarbons illustrated herein. These components are generally applied from a hot roll applicator to the developed, fused MICR images. In this manner, image smearing, and toner offset to the read and write heads in the MICR reader/sorter may be avoided or minimized. Generally, the aforesaid layer is present in an effective thicknesses, for example, from about 0.1 to about 5 microns. Also, the layer can be present as a continuous or semicontinuous component.

With further respect to the present invention, there is provided in specific embodiments a process, including a xerographic process which comprises generating a latent image; developing the image which contains magnetic characters thereon, such as personal checks and the other documents illustrated herein with a toner composition comprised of resin particles, optional pigment particles, magnetic particles, and a polymeric fluorocarbon; and thereafter processing the documents obtained in a reader/sorter; and a xerographic process which comprises forming a latent image on an imaging member; developing the image with a toner composition comprised of resin particles and pigment particles; subsequently transferring the image to a suitable substrate; subsequently permanently affixing the image by, for example, heating or a combination of heating and pressure; and thereafter, or simultaneously applying to the developed image, such as characters present on a personal check document, a polymeric fluorocarbon.

The toner composition of the present invention may include as surface additives colloidal silicas, such as R972, metal salts, or metal salts of fatty acids, such as zinc stearate, in amounts of, for example, from about 0.1 to about 1 percent for example.

With the process of the present invention, radiant fusing, flash fusing, vapor fusing, and fusing with hard or soft rolls can be utilized. When hard roll fusing is selected, reference, for example, the 9700 TM MICR printer mentioned herein, the toner pile height is preferably from about 5 to about 9 microns; and the image offsetting or image smearing advantages indicated are obtained, which advantages are not achieved with such compositions when the polymeric fluorocarbons are not present. Similar results are obtained with soft fuser rolls wherein the toner pile height is preferably from about 9 to about 20 microns. With the aforesaid soft fuser rolls particularly, there results image smearing and offsetting in the reader/sorters when toners without the polymeric fluorocarbons illustrated herein are utilized. Accordingly, with the process of the present invention image smearing and image offsetting advantages are obtained as indicated herein, and less sorter machine contamination is present while simultaneously satisfying ultimate users as the aforesaid and other problems are minimized, especially when soft roll fusers are selected for fixing of the images, reference the Xerox Corporation 4040 TM.

The following examples are being submitted to further define various species of the present invention. These examples are intended to illustrate and not limit the scope of the present invention. Also, parts and percentages are by weight unless otherwise indicated.

EXAMPLE I

There was prepared in a Banbury mixer by melt blending with heating, followed by mechanical attrition, a toner composition comprised of 65 percent by weight of a styrene butadiene resin with 91 percent by weight of styrene and 9 percent by weight of butadiene, 28 percent by weight of the magnetite MO 4232, which toner has incorporated therein as an internal component 7 weight percent of the polymeric fluorocarbon (FEP) a fluorinated ethylene propylene available as Teflon from E. I. DuPont. Also included on the surface of the toner was 0.2 percent by weight of Aerosil R972. The aforementioned toner composition had a triboelectric charge thereon of a minus −16.4 microcoulombs per gram at 2 percent toner concentration with the following carrier as determined in the known Faraday Cage apparatus.

There was prepared a developer composition by admixing the aforementioned formulated toner composition at a 2.9 percent toner concentration, that is 2.9 parts by weight of toner per 100 parts by weight of carrier, which carrier was comprised of a ferrite core, available from Titan Corporation, with a 0.6 weight percent polymeric coating, 80 percent by weight of a terpolymer of styrene, methylmethacrylate, and triethoxy silane containing 20 percent by weight of Vulcan carbon black available from Pfizer, reference U.S. Pat. No. 4,517,268, the disclosure of which is totally incorporated herein by reference.

The aforementioned developer composition was utilized to develop latent images generated in the Xerox Corporation 9700 TM MICR apparatus, commercially available, which images were fused with a hard roll fuser resulting in personal checks with magnetic characters thereon. When these checks, about 500, were utilized in the IBM 3890 TM with a reader/sorter toner, offsetting to the protective foils present on the read and write heads was minimized as evidenced by visual observation, and image smearing did not result on the final images as determined by visual observation. More specifically, 500 of the aforementioned created checks were passed through an IBM 3890 TM sorter 10 times, and the reject rate, that is where the magnetic image characters could not be read, was 0 percent beginning with the first pass and continuing up to the 10th pass, and image smearing was avoided. Thus, out of a total of 5,000 checks processed in the aforesaid aforesaid reader/sorter none were rejected. When repeating the aforementioned process with the exception that there was selected a toner and developer composition without the fluorocarbon, imaging smearing was observed and the protective foil on the read/write heads was contaminated with toner, it being noted that substantially no toner contamination resulted on the aforesaid foils when the same toner and developer were utilized containing the polymeric fluorocarbon. When the above process was repeated in the NCR 6780 TM, which contains no protective foils on the read and write heads, less image smearing was visible with the toner and developer containing the polymeric fluorocarbon Teflon ® compared to image smearing occuring with the utilization of a toner containing no Teflon ®. It is thus believed that machine maintenance can be reduced since there is less toner contamination present when the prepared toners with polymeric fluorocarbons are selected.

Also, similar toner and developer compositions can be prepared and utilized for generating and utilizing checks with substantially similar desirable offsetting and image smearing results, and wherein the polymeric fluorocarbon can be present in an amount of from about 2 to about 10 weight percent as an internal additive, and in an amount of from about 0.3 to about 2 weight percent as an external additive.

Further, there were prepared similar toner and developer compositions with the exceptions that there was selected in place of the Teflon ®, Kynar ®, a polyvinylidene fluoride. When checks formed with the aforementioned Kynar ® developer compositions were utilized in the IBM 3890 TM as illustrated above, toner offsetting to the read and write heads was avoided as evidenced by visual observation, and image smearing did not result as determined by visual observation.

EXAMPLE II

A negatively charged toner composition with a triboelectric charge thereon of −12.5 microcoulombs per gram at 2 percent toner concentration was prepared by repeating the procedure of Example I with the exceptions that 28 percent of the magnetite, 7 percent of Kynar ®, and 0.4 weight percent of Aerosil R812 on the surface thereof were selected. A developer composition was then prepared by repeating the procedure of Example I.

Personal checks were then generated in the Xerox Corporation 9700 TM MICR printer and these checks were subsequently utilized (sorted) in the IBM 3890 TM by repeating the procedure of Example I, and substantially similar results were obtained, that is toner offsetting (contamination) to the read and write heads was substantially avoided as evidenced by visual observation, and image smearing did not result on the final images as determined by visual observation for 5,000 checks. The reject rate was 0.09 percent.

EXAMPLE III

Toner and developer compositions were prepared by repeating the processes of Example II with the exceptions that the toner contained 68 percent of resin, 4 weight percent of Kynar ® as an internal additive and 0.5 weight percent of the Aerosil R972. Personal checks were then sorted in the IBM 3890 TM by repeating the processes of Example I and substantially similar results were obtained with regard to smear reduction. The reject rate for 5,000 checks was 0 percent.

EXAMPLE IV

Toner and developer compositions were prepared by repeating the procedure of Example II, and thereafter the personal checks generated were utilized in the NCR 6780 TM. Substantially similar results were obtained, that is substantially no image smearing resulted when compared with the same toner containing no polymeric fluorocarbon.

EXAMPLE V

Personal check documents can be prepared by repeating the process of Example I with the exception that the toner selected contained no Teflon, and 72 percent by weight of the resin particles. Subsequent to fusing in each instance, there can be applied by a silicone fuser roll to each of the checks generated a continuous layer, 2.5 microns in thickness, of the Teflon® of Example I. Subsequent to sorting in the IBM 3890 TM, the reject rate for 100,000 checks with the wax layer thereon is 0.3 percent.

A toner and developer composition is prepared by repeating the procedure of Example I with the exception that there is added thereto 2 percent by weight of Regal 330® carbon black as pigment particles, and there is selected 63 percent by weight of the styrene butadiene resin. Substantially similar results can be obtained, it is believed, when the personal checks generated with magnetic characters thereon are utilized in the IBM 3890 TM with a reader/sorter. More specifically, the reject rate is 0.1 percent, and image smearing is minimized.

When the aforementioned toner and developer compositions are utilized in the Xerox Corporation 4045 TM wherein the images are fixed with a radiant fuser, substantially similar results can be obtained, it is believed, as reported in Example II. Also, when a similar toner and developer composition without the polymeric fluorocarbon is selected and personal checks are generated in the Xerox Corporation 4045 TM, and subsequently sorted in the IBM 3890 TM, substantially similar results are obtained as reported in Example I, that is toner contamination on the read/write heads will result, it is believed.

Other modifications of the present invention may occur to those skilled in the art subsequent to a review of the present application. The aforementioned modifications, including equivalents thereof, are intended to be included within the scope of the present invention.

What is claimed is:

1. An imaging process which comprises the generation of a latent image; developing the image with a toner composition comprised of resin particles, magnetite particles, and a polymeric fluorocarbon selected from the group consisting of polyvinylidene fluoride, polytetrafluoroethylene, polyvinyl fluoride, fluorinated ethylene propylene, polypentafluorostyrene, and mixtures thereof; and subsequently providing the developed image with magnetic ink characters thereon to a reader/sorter device whereby toner offsetting and image smearing is avoided or minimized in said device.

2. An imaging process which comprises the generation of a latent image in an electronic printing magnetic image character recognition apparatus; thereafter developing the image with a toner composition comprised of resin particles, magnetite particles, and a polymeric fluorocarbon selected from the group consisting of polyvinylidene fluoride, polytetrafluoroethylene, polyvinyl fluoride, fluorinated ethylene propylene, polypentafluorostyrene, and mixtures thereof; and subsequently providing the developed image with magnetic ink characters thereon to a reader/sorter device whereby toner offsetting and image smearing is avoided or minimized in said device.

3. An imaging process in accordance with claim 2 wherein there is present on the surface of the toner flow aid additive components.

4. An imaging process in accordance with claim 3 wherein the flow aid additive is colloidal silica.

5. A process in accordance with claim 2 wherein the toner composition contains as surface additives metal salts, or metal salts of fatty acids.

6. A process in accordance with claim 2 wherein the toner composition contains pigment particles.

7. A process in accordance with claim 2 wherein the toner composition contains magnetite particles in an amount of from about 28 to about 70 percent by weight, and pigment particles in an amount of from about 2 to about 10 percent by weight.

8. A process in accordance with claim 2 wherein a soft roll fuser is selected for affixing the developed latent images.

9. A process in accordance with claim 2 wherein the polymeric fluorocarbon is polytetrafluoroethylene, polyvinylidene fluoride, polyvinylfluoride, fluorinated ethylene propylene, or mixtures thereof.

10. A process in accordance with claim 2 wherein the polymeric fluorocarbon is present as an internal, or as an external component.

11. A process in accordance with claim 2 wherein the polymeric fluorocarbon is present in an amount of from about 0.1 percent by weight to about 10 percent by weight.

12. A process in accordance with claim 2 wherein the resin particles are selected from the group consisting of polyesters, styrene butadiene copolymers, styrene acrylate copolymers, and styrene methacrylate copolymers.

13. A process in accordance with claim 12 wherein the styrene butadiene copolymer contains 91 percent by weight of styrene, and 9 percent by weight of butadiene.

14. A process in accordance with claim 2 wherein the magnetite is present in an amount of from about 28 to about 70 percent by weight.

15. A process in accordance with claim 2 wherein the magnetite is acicular and is present in an amount of from about 15 to about 40 percent by weight.

16. A process in accordance with claim 2 wherein the magnetite is cubic and is present in an amount of from about 50 to about 60 percent by weight.

17. A process in accordance with claim 2 wherein the toner composition contains a charge enhancing additive.

18. A process in accordance with claim 17 wherein the charge enhancing additive is selected from the group consisting of distearyl dimethyl ammonium methyl sulfate, cetyl pyridinium halides, and stearyl phenethyl dimethyl ammonium tosylates.

19. A process in accordance with claim 17 wherein the charge enhancing additive is selected from the group consisting of Spilon TRH and potassium tetraphenyl borate.

20. A process in accordance with claim 17 wherein the charge enhancing additive is present in an amount of from about 0.05 percent by weight to about 5 percent by weight.

21. A process for generating personal checks which comprises generating images in an electronic printing device; developing the images with a developer composition comprised of a toner containing resin particles having dispersed therein pigment particles, and a polymeric fluorocarbon component selected from the group consisting of polyvinylidene fluoride, polytetrafluoroethylene, polyvinyl fluoride, fluorinated ethylene propylene, polypentafluorostyrene, and mixtures thereof, and carrier particles; transferring the images to a substrate; fusing the images thereto; and subsequently providing the checks with magnetic ink characters thereon to a reader/sorter device whereby toner offsetting and image smearing is substantially avoided.

22. A process in accordance with claim 21 wherein the resulting checks are utilized in the IBM 3890 TM or NCR 6780 TM reader/sorter device, and wherein image smearing and image offsetting is substantially avoided.

23. A process in accordance with claim 21 wherein the resulting checks are utilized in a reader/sorter device, and wherein image smearing and image offsetting to the read and write heads is substantially avoided.

24. A process in accordance with claim 21 wherein the resulting checks are utilized in a reader/sorter device, and wherein image smearing and image offsetting to a protective foil present on the read and write heads is avoided.

25. A process in accordance with claim 21 wherein the reject rate in the reader/sorter device is less than one half of one percent.

26. A xerographic process for the preparation of personal checks which comprises generating latent images with high or low speed electronic printing devices; thereafter developing the image with a developer composition comprised of a toner composition containing resin particles, magnetite particles, and a polymeric fluorocarbon component selected from the group consisting of polyvinylidene fluoride, polytetrafluoroethylene, polyvinyl fluoride, fluorinated ethylene propylene, polypentafluorostyrene, and mixtures thereof, and carrier particles; and subsequently providing the checks with magnetic ink characters thereon to a reader/sorter device whereby toner offsetting and image smearing is substantially avoided.

27. A process in accordance with claim 26 wherein the carrier particles contain a polymeric coating thereover.

28. A process in accordance with claim 27 wherein the carrier particles are comprised of a steel or a ferrite core with a coating thereover selected from the group consisting of polychlorotrifluoroethylene-covinylchloride copolymer, a polyvinylidene fluoropolymer, or a terpolymer of styrene, methacrylate, and an organo silane, fluorinated ethylenepropylene copolymers, and polytetrafluoroethylene.

29. A process in accordance with claim 26 wherein the toner contains a charge enhancing additive.

30. A process in accordance with claim 29 wherein the charge enhancing additive is distearyl dimethyl ammonium methyl sulfate.

31. A process in accordance with claim 26 wherein the read/write heads are free of image smearing after the documents generated are passed through a magnetic ink character recognition sorter, and the reject rate is less than one half of one percent.

32. A process in accordance with claim 27 wherein toner offsetting is avoided after the documents generated are passed through a magnetic ink character recognition sorter.

33. A process which comprises the formation of a latent image on a photoconductive member in an electronic imaging apparatus; developing the image with a toner composition comprised of resin particles having dispersed therein magnetite particles, and a polymeric fluorocarbon; subsequently transferring the image to a supporting substrate; fixing the image; thereafter applying to the developed image during or subsequent to fusing a layer of said polymeric fluorocarbon selected from the group consisting of polyvinylidene fluoride, polytetrafluoroethylene, polyvinyl fluoride, fluorinated ethylene propylene, polypentafluorostyrene, and mixtures thereof; and subsequently providing the documents with magnetic ink characters thereon to a reader/sorter device whereby toner offsetting and image smearing is substantially avoided.

34. A process in accordance with claim 33 wherein the fluorocarbon is present as an external additive.

35. A process in accordance with claim 33 wherein the fluorocarbon is present as an internal additive.

36. A xerographic process which comprises forming a latent image on an imaging member; developing the image with a toner composition comprised of resin particles, magnetite particles, and optional additive particles; subsequently transferring the image to a suitable substrate; fixing the image thereto; thereafter applying to the developed image a polymeric fluorocarbon selected from the group consisting of polyvinylidene fluoride, polytetrafluoroethylene, polyvinyl fluoride, fluorinated ethylene propylene, polypentafluorostyrene, and mixtures thereof; and subsequently providing the documents with magnetic ink characters thereon to a reader/sorter device whereby toner offsetting and image smearing is substantially avoided.

37. A process in accordance with claim 1 wherein there is added to the toner composition carrier particles.

38. A process in accordance with claim 20 wherein a soft fuser roll is selected for affixing the developed image.

39. A process in accordance with claim 20 wherein a hard fuser roll is selected for affixing the developed image.

40. A xerographic process for the preparation of personal checks which comprises generating latent images with high or low speed electronic printing devices; thereafter developing the image with a developer composition comprised of a toner composition containing resin particles, magnetite particles, and a polymeric fluorocarbon selected from the group consisting of polyvinylidene fluoride, polytetrafluoroethylene, polyvinyl fluoride, fluorinated ethylene propylene, polypentafluorostyrene, and mixtures thereof; and subsequently providing the checks with magnetic ink characters thereon to a reader/sorter device whereby toner offsetting and image smearing is substantially avoided.

41. A process in accordance with claim 39 wherein carrier particles are added to the toner composition, or the toner composition is added to carrier particles.

42. A process which comprises the generation of a latent image; developing the image with a toner composition comprised of resin particles, magnetite particles, and a polymeric fluorocarbon selected from the group consisting of polyvinylidene fluoride, polytetrafluoroethylene, polyvinyl fluoride, fluorinated ethylene propylene, polypentafluorostyrene, and mixtures thereof; and subsequently providing the developed image with magnetic ink characters thereon to a reader/sorter device.

43. A process in accordance with claim 42 wherein the polymeric fluorocarbon is present as an internal component.

44. A process in accordance with claim 42 wherein the polymeric fluorocarbon is present as an external component.

45. A process in accordance with claim 42 wherein the polymeric fluorocarbon is present in an amount of from about 0.1 percent by weight to about 10 weight percent.

46. A process in accordance with claim 42 wherein the polymeric fluorocarbon is available at the surface of the toner in an amount of from about 2 to about 10 weight percent.

47. A process in accordance with claim 42 wherein the polymeric fluorocarbon is present as an internal additive incorporated into the toner in an amount of from about 0.3 to about 2 weight percent.

48. A process in accordance with claim 42 wherein toner offsetting and image smearing are avoided.

49. A process in accordance with claim 42 wherein toner offsetting and image smearing are minimized.

50. A process in accordance with claim 42 wherein the latent image is generated in an electronic printing magnetic image character recognition apparatus.

51. A process in accordance with claim 50 wherein toner offsetting and image smearing are minimized.

52. A process in accordance with claim 50 wherein toner offsetting and image smearing are avoided.

53. An electrophotographic process which comprises the generation of a latent image; developing the image with a toner composition comprised of resin particles, magnetite particles, and a polymeric fluorocarbon selected from the group consisting of polyvinylidene fluoride, polytetrafluoroethylene, polyvinyl fluoride, fluorinated ethylene propylene, polypentafluorostyrene, and mixtures thereof, and subsequently providing the developed image with magnetic ink characters thereon to a reader/sorter device whereby image smearing is avoided or minimized in said device.

54. A xerographic process for the preparation of personal checks which comprises generating latent images with high or low speed electronic printing devices; thereafter developing the image with a developer composition comprised of a toner composition containing resin particles, magnetite particles, and a polymeric fluorocarbon component selected from the group consisting of polyvinylidene fluoride, polytetrafluoroethylene, polyvinyl fluoride, fluorinated ethylene propylene, polypentafluorostyrene, and mixtures thereof, and carrier particles.

55. An imaging process which comprises the generation of a latent image; developing the image with a toner composition comprised of resin particles, magnetite particles, and a polymeric fluorocarbon selected from the group consisting of polyvinylidene fluoride, polytetrafluoroethylene, polyvinyl fluoride, fluorinated ethylene propylene, polypentafluorostyrene, and mixtures thereof; and subsequently providing the developed image with magnetic ink characters thereon to a reader/sorter device.

* * * * *